United States Patent [19]

Hayskar et al.

[11] 4,428,794

[45] Jan. 31, 1984

[54] APPARATUS FOR SEALING ENVELOPES

[75] Inventors: Robert A. Hayskar, Palatine; Robert A. Stock, Crystal Lake, both of Ill.

[73] Assignee: Xerox Corporation, Stamford, Conn.

[21] Appl. No.: 405,008

[22] Filed: Aug. 4, 1982

[51] Int. Cl.[3] ..... B65B 11/48

[52] U.S. Cl. ..... 156/442.1; 53/376; 53/383; 156/227; 156/442.2; 156/578

[58] Field of Search ..... 156/212, 213, 216, 227, 156/441.5, 475, 477.1, 479, 442.1, 442.2, 578; 53/376, 377, 266 A, 383; 118/258, 260

[56] References Cited

U.S. PATENT DOCUMENTS

| | | | |
|---|---|---|---|
| 1,043,053 | 10/1912 | Wakefield | 156/442.1 |
| 1,165,001 | 12/1915 | Dunlap | 118/258 |
| 1,195,310 | 8/1916 | White et al. | 118/258 |
| 1,446,256 | 2/1923 | Lane et al. | 53/376 |
| 2,749,689 | 1/1956 | Colley | 53/124 |
| 2,855,894 | 10/1958 | White et al. | 118/258 |
| 3,550,351 | 12/1970 | Gombault | 53/383 |
| 4,004,962 | 1/1977 | Kleid | 156/475 |
| 4,228,996 | 10/1980 | Wilcox, Jr. | 271/297 |

*Primary Examiner*—Jerome W. Massie

*Attorney, Agent, or Firm*—Frederick E. McMullen

[57] ABSTRACT

Envelope sealing apparatus employing a deflector to deflect the leading envelope flap out of the normal path through which the envelope moves and into contact with a reversely moving water wheel which wets the flap to activate adhesive thereon. The inherent rigidity of the envelope proper is relied on to thereafter force the deflector aside, permitting the envelope proper to pass the water wheel without contacting the same. As the envelope continues along the path, a diverter causes the deflected envelope flap to curl under and as the envelope passes thereby, forces in cooperation with the water wheel the envelope flap into closing relationship with the envelope. A downstream sealing roller completes closing and sealing of the envelope.

5 Claims, 6 Drawing Figures

Figures 1, 2A, 2B, 2C, 2D, 2E:
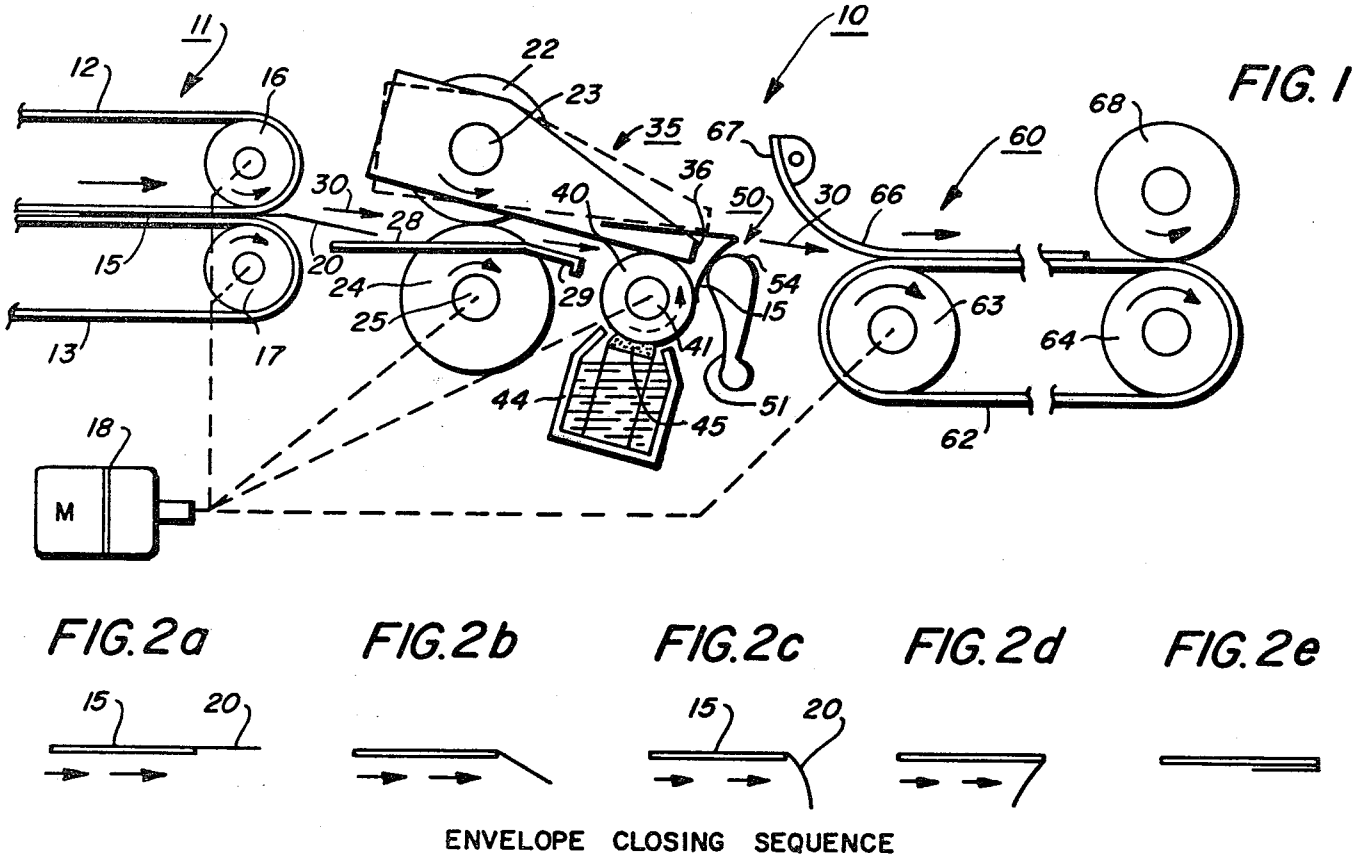

ENVELOPE CLOSING SEQUENCE
M

APPARATUS FOR SEALING ENVELOPES

This invention relates to an envelope sealing apparatus, and more particularly, to an envelope sealing apparatus designed to avoid the need for operator set-up and external activating devices.

In conventional envelope sealing apparatuses and systems, a large degree of operator involvement is required in order to set up the apparatus to handle the correct size and type of envelopes being sealed and to maintain the sealing apparatus in operating condition. In these types of sealing apparatus, a change in envelope type, for example, from a relatively thin business envelope to a package or delivery type envelope normally requires operator intervention to reset and adjust the various operating components for the different thickness envelope materials.

Additionally, current envelope sealing machines are susceptible to changes in speed as well as changes in the thickness of the envelope being sealed. Thus, where these devices are coupled to a source of envelopes such as an inserter, changes in speed of the envelope source, as for example, by changeover from one envelope source to another type of envelope source often necessitates a fresh adjustment of the envelope sealing apparatus by the operator. With operator labor rates at an all time high, the economic benefits to be reaped by reducing operator involvement are substantial indeed.

The present invention is designed to overcome the foregoing handicaps and to provide an envelope sealing apparatus which requires minimal operator involvement, which is highly insensitive to speed or media conditions, and which effects sealing without changing or requiring a change in envelope direction, the apparatus consisting of a pinch roll pair for advancing envelopes with the envelope flap extended along a predetermined envelope path; a water wheel turning in a direction opposite the pinch roll pair; and deflector means for deflecting the envelope flap out of the envelope normal path and into contact with the water wheel, the water wheel wetting the envelope flap to activate adhesive on the flap as the envelope moves along the envelope path, and past the water wheel, reverse rotation of the water wheel assisting in closing the flap to seal the envelope automatically as the envelope moves through the apparatus.

IN THE DRAWINGS

FIG. 1 is a schematic view showing details of the envelope sealing apparatus of the present invention; and FIGS. 2*a*–2*e* are schematic views illustrating the envelope processing sequence followed by the apparatus of the present invention.

Referring particularly to FIG. 1 of the drawings, the envelope sealing apparatus 10 of the present invention includes a suitable envelope transport 11 for bringing envelopes 15 to be sealed forward in succession. Transport 11 comprises cooperating upper and lower feed belts 12, 13 supported by suitable rolls of which only the downstream rolls 16, 17 are shown. Rolls 16, 17 are drivingly coupled by suitable means (not shown) to a suitable drive motor 18, motor 18 serving to rotate rolls 16, 17 and move envelope transport belts 12, 13 mounted thereon in the direction shown by the solid line arrow of the drawing.

Envelopes 15, which are supplied from a suitable source (not shown), are fed face down with the envelope flap 20 open, envelopes 15 being advanced flap first. A pinch roll pair 22, 24 is provided downstream of envelope transport 11 to receive the envelopes 15 discharged by transport 11 and advance the envelopes forward for moistening and sealing of the envelope flap 20 as will appear. Pinch roll pair 22, 24 are carried by shafts 23, 25 respectively which in turn are rotatably supported on a suitable frame (not shown). Drive motor 18 is drivingly coupled to one or both shafts 23, 25 by suitable means (not shown) to turn pinch rollers 22, 24 in the direction shown by the solid line arrows of the drawing.

To support the envelopes 15 and direct movement of the envelopes from transport 11 into the nip formed by pinch rolls 22, 24, a guide member 28 is provided at the discharge side of envelope transport 11. Guide member 28 extends to a point downstream of pinch rolls 22, 24, guide member 28 being supported so that member 28 is slightly below the path 30 of movement of envelopes 15. Guide member 28 is provided with a suitable aperture therein (not shown) to accommodate pinch roll 24. An envelope flap deflector 35 is pivotally supported above the envelope path 30 such that the projecting end 36 thereof is opposite to and cooperates with a water wheel 40 to form a nip into which the envelope flap 20 enters downstream of pinch rolls 22, 24. Flap deflector 35 may be conveniently supported on pinch roll shaft 23 by suitable bearing means (not shown) which permits deflector 25 to turn freely on shaft 23. To facilitate operation of envelope flap deflector 35, the trailing edge 29 of guide member 28 is turned downwardly.

Water wheel 40, which serves to moisten the envelope flap 20 to thereby activate the adhesive coating thereon, has shaft 41 thereof rotatably mounted on the apparatus frame (not shown). Drive motor 18 is coupled to water wheel shaft 41 by suitable means (not shown) to turn wheel 40 in a direction opposite to the direction in which envelopes 15 are transported as shown by the dotted line arrow of the drawing. Water wheel 40 is preferably formed from stainless steel to obviate corrosion and control the amount of moisture transmitted to the envelope flaps 20. A reservoir 44 is disposed below water wheel 40 on the apparatus frame (not shown), reservoir 44 serving to hold a supply of envelope adhesive activating liquid, normally, water. A sponge-like element 45, mounted so that the upper side thereof slidably contacts or wipes against the exterior of water wheel 40 and the lower side is deposited within reservoir 44, serves to apply water from reservoir 44 onto water wheel 40.

A downwardly projecting flap diverter 50 is spaced adjacent to and downstream of water wheel 40. The forward face 51 of diverter 50 is concave, diverter 50 serving to intercept and turn the flap of the approaching envelope downwardly as the envelope 15 is transported along the path 30. Diverter 50 is suitably mounted in fixed position on the apparatus frame (not shown), diverter 50 being located so that the upper side 54 thereof is slightly below the path 30 of envelope 15.

A discharge conveyor 60 downstream of diverter 50 is provided to close and seal the envelope flap 20 following moistening thereof by water wheel 40, and to carry the envelope to a suitable output station (not shown). Discharge conveyor 60 has a lower endless belt 62 stretched across drive and idle rollers 63, 64, drive roller 63 being suitably coupled to motor 18 for rotation in the direction shown by the solid line arrow. An upper guide 66 is disposed adjacent the inlet to discharge conveyor 60, guide 66 cooperating with belt 62 to form a nip into which the envelope 15 passes following moistening of the flap 16 thereof. Preferably, guide 66 is curved at 67 to facilitate passage of the envelope into the nip formed by belt 62 and guide 66.

A sealing roll 68 is disposed in pressure contact with belt 62 of discharge conveyor 60, pressure between belt 62 and roll 68 cooperating to pinch the envelope and flap together to seal the envelope. To provide requisite support, sealing roll 68 is preferably disposed opposite belt support roll 64.

It will be understood that the dimensions of the various operating components of sealing apparatus 10 are sufficient to accommodate the largest envelope to be processed.

OPERATION

Referring to FIGS. 1 and 2, and presuming drive motor 18 to be energized to operate envelope transport 11, pinch rolls 22, 24, water wheel 40 and discharge transport 60, envelopes 15 to be sealed are brought face down to the envelope sealing apparatus 10 by envelope transport 11 (FIG. 2*a*), each envelope 15 being open and oriented so that the envelope flap 20 is first. Conveyor 11 discharges each envelope into the nip formed by rolls 22, 24, which continue to advance the envelope forward across guide member 28 to flap deflector 35 and water wheel 40. As the envelope approaches the nip formed by deflector 25 and water wheel 40, the envelope flap 20 impinges against the underside of deflector 35 forcing the envelope flap to turn downardly and into the nip formed by deflector 35 and water wheel 40 (FIG. 2*b*). As the envelope flap 20 emerges, the envelope flap strikes against the surface 51 of diverter 50 which guides or turns the envelope flap downwardly (FIG. 2*c*) with the adhesive bearing side of the envelope flap 20 facing in the direction of water wheel 40.

As the envelope flap 20 passes between the nip formed by deflector 35 and water wheel 40, the wetted surface of wheel 40 moistens the flap 20 to activate the adhesive thereon.

Since envelope flap deflector 35 is free to turn about supporting shaft 23 and since the spine of the envelope proper (i.e. the double sided portion of the envelope to which flap 16 is attached) is inherently stiff, subsequent impact of the relatively stiff spine of the envelope proper with deflector 35 forces the deflector 35 upwardly and out of the path 30 of envelope movement. With water wheel 40 and diverter 50 disposed somewhat below the path 30 of envelope travel, the envelope proper continues to move along the normal path 30 of travel raising to pass across the upper end 54 of diverter 50 and out of contact with water wheel 40. At the same time, the downwardly directed envelope flap 20 is tucked under (FIG. 2*d*), and with the assistance of water wheel 40, forced upwardly folding the flap 16 under the body of the envelope 15 passing thereover. As the leading edge of the envelope with the now moistened flap 20 folded thereunder emerges, the envelope enters the nip formed by belt 62 and guide member 66 of discharge transport 60 for transportation to sealing roller 68 and the output station. Sealing roller 68 cooperates with belt 62 to pinch the envelope flap closed to complete the sealing operation (FIG. 2*e*).

While a single envelope flap deflector 35 has been shown and described, multiple axially spaced deflectors may instead be contemplated. And, instead of relying on the envelope itself to displace the deflector 35 during the envelope sealing process, an independent operator such as a rotary solenoid, air cylinder, cam, or other suitable driver, may be provided to raise deflector 35 out of the path 30 of envelope movement. And while the envelope sealing apparatus 10 has been shown and described as including flap diverter 50, diverter 50 may in some applications be omitted. In that event, the deflecting action of envelope flap deflector 35 on the envelope flap 20 as the envelope 15 moves along the path 30 in cooperation with the reversely rotating water wheel 40 provides the requisite envelope flap closing movement to effect sealing.

The envelope sealing apparatus of the present invention provides a sealing apparatus that requires only minimal operator attention and involvement, and is relatively insensitive to speed. Further, the sealing apparatus processes and seals envelopes in the same direction as the envelopes are inserted and without changing envelope direction.

While the invention has been described with reference to the structure disclosed, it is not confined to the details set forth, but is intended to cover such modifications or changes as may come within the scope of the following claims.

We claim:

1. Envelope sealing apparatus comprising (a) a pinch roll for advancing envelopes with the envelope flap extended along a predetermined envelope path;

(b) a water wheel turning in a direction opposite said pinch roll pair, said water wheel being spaced from said envelope path; and (c) deflector means for deflecting the envelope flap out of said envelope path and into contact with said water wheel, said water wheel wetting said flap to activate adhesive on said flap as said envelope moves along said envelope path and past said water wheel, reverse rotation of said water wheel assisting in closing said flap to seal the envelope automatically as the envelope moves through the apparatus.

2. The apparatus according to claim 1 including an envelope flap diverter downstream of said water wheel, said deflector means deflecting said envelope flap into contact with said envelope flap diverter whereby said envelope flap diverter forces said envelope flap toward a closing position in cooperation with said water wheel.

3. The apparatus according to claim 1 including means for moving said deflector means aside to permit the body of said envelope to follow said envelope path and avoid said water wheel.

4. The apparatus according to claim 1 in which said deflector means comprises at least one deflecting finger supported for free pivotal movement, one end of said deflecting finger normally resting on said water wheel and cooperable therewith to form a nip through which said envelope flap passes, the inherent stiffness of said envelope proper forcing said deflecting finger aside to permit said envelope proper to follow said envelope path and avoid contact with said water wheel.

5. An apparatus for closing and sealing the adhesive bearing flap portion of envelopes comprising in combination:

(a) an input transport for bringing envelopes to be sealed forward flap first along a predetermined path;

(b) at least one flap deflector for depressing the flap of said envelope out of the path of movement of said envelopes;

(c) at least one flap diverter downstream of said deflector for intercepting said depressed envelope flap and causing said flap to project downwardly;

(d) means to moisten said flap to actuate said adhesive and to assist in closing said flap, said moistening means being disposed adjacent to and upstream of said diverter so that said downwardly projecting flap is proximate to said moistening means and being capable of rotating opposite to the feed direction of said envelope; and (e) output transport means downstream of said moistening means for receiving said envelopes;

(f) said diverter being disposed below said envelope path so that as said envelope flap is turned downwardly by said diverter the inherent stiffness of said envelope causes said envelope proper to continue to move along said path and past said diverter to said output transport means causing said flap to be tucked under said envelope and drawn into contact with said moistening means whereby said adhesive is activated, said output transport means having sealing means for pinching said envelope and flap together to close said flap and seal said envelope.

* * * * *